United States Patent [19]

Pacione

[11] Patent Number: 5,060,443

[45] Date of Patent: Oct. 29, 1991

[54] ANCHOR BOARD SYSTEM

[75] Inventor: Joseph R. Pacione, Thornhill, Canada

[73] Assignee: Tac-Fast Systems SA, Fribourg, Switzerland

[21] Appl. No.: 381,834

[22] Filed: Jul. 19, 1989

Related U.S. Application Data

[63] Continuation-in-part of Ser. No. 148,711, Jul. 22, 1988, abandoned.

[51] Int. Cl.[5] ..... E04B 1/38

[52] U.S. Cl. ..... 52/506; 52/511; 52/DIG. 13; 428/100

[58] Field of Search ..... 52/DIG. 13, 511, 506, 52/202; 428/99, 100

[56] References Cited

U.S. PATENT DOCUMENTS

| | | | |
|---|---|---|---|
| 3,444,657 | 5/1964 | Swanson | 52/417 |
| 3,583,057 | 6/1971 | Kolozsvary | 52/DIG. 13 |
| 3,721,050 | 3/1973 | Perina | 52/DIG. 13 |
| 3,807,112 | 4/1974 | Perina | 52/DIG. 13 |
| 4,090,335 | 5/1978 | Curatolo | 52/DIG. 13 |
| 4,177,305 | 12/1979 | Feingold | 52/DIG. 13 |
| 4,281,211 | 7/1981 | Tatum | 174/36 |
| 4,353,193 | 10/1982 | Sanderson | 52/311 |
| 4,457,510 | 7/1984 | Pertschuk | 128/DIG. 5 |
| 4,602,124 | 7/1986 | Santucci | 52/287 |
| 4,635,418 | 1/1987 | Hobgood | 52/DIG. 13 |
| 4,691,478 | 9/1987 | Lorg | 52/DIG. 13 |
| 4,711,025 | 12/1987 | DeSanto | 174/72 A |
| 4,722,146 | 2/1988 | Kemeny | 52/DIG. 13 |
| 4,730,432 | 5/1988 | Schafer | 52/287 |
| 4,744,189 | 5/1988 | Wilson | 52/DIG. 13 |
| 4,747,246 | 5/1988 | Sanborn | 52/DIG. 13 |
| 4,845,910 | 7/1989 | Hanson | 52/DIG. 13 |

OTHER PUBLICATIONS

Popular Science; Aug. 1964, p. 113.

Mad Magazine, May 1984, p. 40.

Snap Wall publication, 4 pages.

*Primary Examiner*—Henry E. Raduazo

*Attorney, Agent, or Firm*—Brian W. Gray; Robert H. Wilkes; Jane Parsons

[57] ABSTRACT

An anchor-board construction system suitable for incorporation into the interior of buildings and homes is disclosed for use as a cladding to replace conventional plaster based wall board similar to that known in the trade as gyprock, having one surface thereof incorporating a layer of protruding attachment hooks. These hooks can accept and retain decorative and functional surface finish units embodying a looped or other suitably "piled" posterior surface portion, for attachment to the hooks. For use, within a building as a wall system, the novel anchor boards are secured into postion as an underlying wall layer, and a selected form of area finish embodying a complementary attachment surface is secured thereto simply by pressing into place. The area finish can be carpet tiles, wallpaper or fabric with looped backing or wood paneling. The system includes provision for trims, baseboards, cornice moldings, door moldings and outlet covers together with electrical conduit and permits rapid erection, replacement and change-over, with low associated labor costs. The system may further include a double sided anchor board, having an attachment hook strata on the obverse face as above described and an attachment loop strata on the reverse face, for use in cooperation with wall building supporting members. The wall building supporting members, in turn, incorporate an obverse face having a hook strata to which the anchor board is adheringly attached. Such a wall building supporting member as an I-beam may carry a complete partition suspended therefrom, the I-beam having a hook strata on each outer face, to receive a respective anchor board in secured relation therewith.

5 Claims, 4 Drawing Sheets

50
52
54
39
21
20
40
41
32
24
34
36
90
38
19

FIG.7.
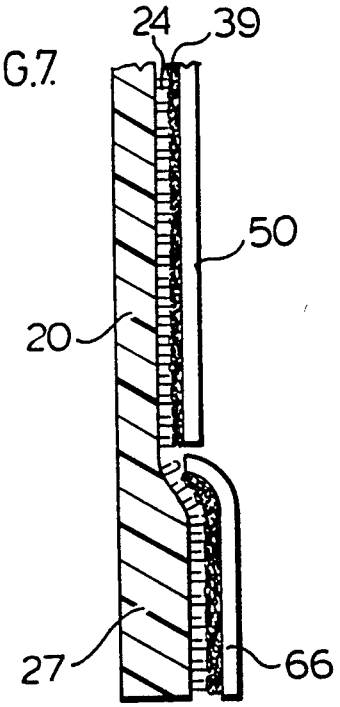
FIG.8.
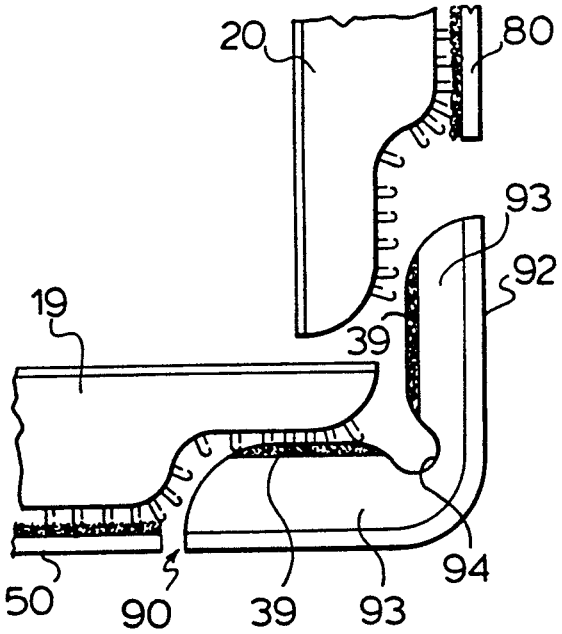
FIG.9.
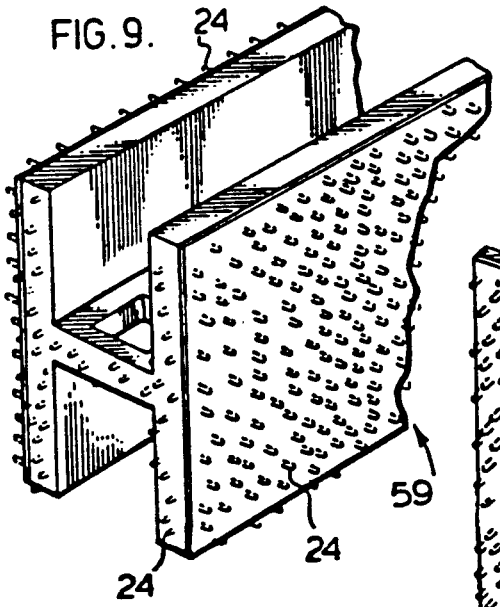
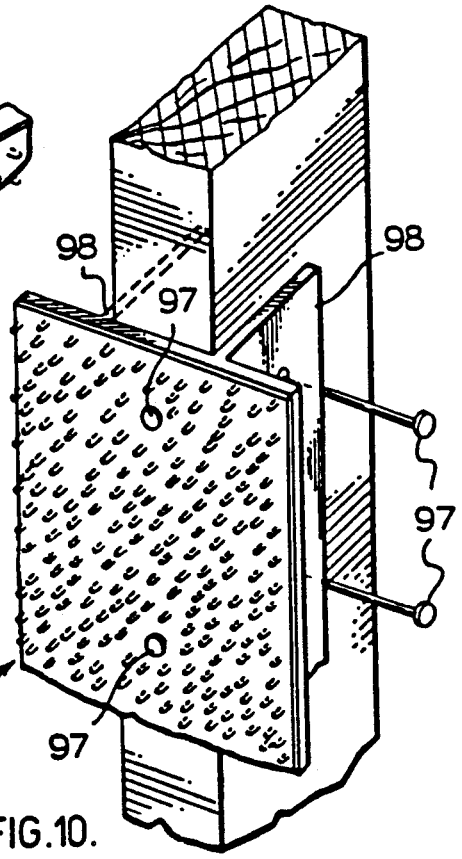
FIG.10.

ANCHOR BOARD SYSTEM

This is a continuation-in-part of application Ser. No. 148,711 filed July 22, 1988, now abandoned.

BACKGROUND OF THE INVENTION

1. Field of the Invention

This invention relates to anchor boards or cladding to be cut and fit on a job site for forming wall surfaces or other surfaces, a front face presenting one half of a hook and loop type fastening system and providing for the application of finishing material to finish the cladding and cover any joins.

2. Background of the Invention

In the construction and interior decorating industry, widespread use is made of drywall construction wherein interior area enclosure such as interior surface walls are usually formed by nailing or screwing drywall panels to frame members after which finishing is necessary. Such finishing involves covering of nail or screw heads and joins between drywall panels to provide a continuous smooth surface which does not show the joins or nail or screw heads. The surface must be free from both dents and bumps.

Drywall panels often have slightly recessed joining margins so that tape may be applied over joins without forming a ridge in the surface. However, frequently the panels must be cut to fit and these recessed margins may not be conveniently used. Thus a large amount of skilled labour is needed involving the application of tape and plaster over adjoining board joints, the plaster being applied in several layers with sanding between each layer. The process, in addition to requiring skilled labor is time consuming and generates quantities of fine chalk dust as a consequence of the necessary intervening sanding-down procedures. The dust itself constitutes a health hazard, as well as being a general nuisance. Fairly complex carpentry is required for door and window trim and for baseboard and cove.

Even when all the drywall is completed, finished and trimmed, it is necessary to apply paint and/or wall paper. Paint usually needs at least a subcoat and a finishing coat of paint and wall paper requires pasting (or wetting to activate pre-applied paste) and accurate cutting. Decorative paneling can be glued or nailed into place. Tiling requires application of adhesive and later grouting. The labour-intensive nature of all the necessary stages is self-evident, and well known.

In the case of floors, a subfloor, often of plywood is laid on the rough base and nailed down. Thereafter the application of vinyl, parquet floor or any other type of floor is again a skilled job.

In all cases a mistake, once made can only usually be corrected by use of a second finish sheet since the first is usually badly damaged and not reusable.

SUMMARY OF THE INVENTION

An attempt has been made to provide a wall or other surface covering which may be a primary covering, i.e. it may be a wall covering attachable directly to an open wall framework, and which presents a surface in less need of skilled finishing operators than is conventional.

Thus according to the invention there is provided cladding to form interior surfaces of buildings, the cladding comprising substantially rigid sheet material adapted to be cut to fit the shape of an area to be clad and being attachable to a backing support; the sheet material having one half of a hook and loop attachment system projecting from a front surface of the sheet material and distributed at least substantially over the whole of the front surface whereby finishing material having the other half of the hook and loop attachment system on a rear surface may be attached anywhere on the front surface.

Also according to the invention there is provided a method of finishing an interior wall of a building comprising the steps of transporting cladding panels to a location to be finished, such cladding panels having one half of a hook and loop attachment system projecting from one face and distributed at least substantially over the whole of the front face and adapted to be trimmed and fit as required; trimming the cladding panels to fit edge to edge with one another and with boundaries of the location to be finished to form interior surfaces; attaching the cladding panels at the location to be finished with said one face to the interior thereof; adding surface finish sheet having a complementary one-half of a hook and loop system.

The cladding may conveniently be provided in the form of panels which may be of a size as to be handled without undue difficulty. The panels may be cut into smaller pieces and may be trimmed to the required shape of the area to be covered. For this purpose it is preferable if the cladding is substantially covered with one half of the hook at loop system and is of substantially uniform cross-section at the edges so that the cladding can be cut at any location as required for fitting in place on a job site.

The edges of the panels or the edges of a single sheet to cover the area, should preferably be sharp and clean and the walls in the width of the panels should be perpendicular to the faces to allow for clean joins between panels. When panels are cut to fit together the cuts should be perpendicular to the face and should be as clean as possible so that the panel edges may be abutted with minimum noticeability of the join. When the panels are for use as walls, they may be of plasterboard construction. In this case it may be convenient that, as is conventional for plasterboard, the paper surface extends around at least one pair of opposed edges for protection of those edges. However, when plasterboard cladding according to the invention is erected there is a variation in requirements from those of conventional plasterboard.

Conventional plasterboard may be provided with a wrapped edge for protection. This wrapped edge may have curved edges so that it merges smoothly with the faces of the board. Moreover, the edge may be bounded by a depressed margin. The curved edges form a slight groove between adjoining conventional plasterboard panels and the depressed margins form a channel for tape bridging the panels. The groove is a convenient receptacle for a first layer of filling plaster and the tape channel is intended to prevent the bridging tape upstanding from the surface.

None of these considerations are desirable in the present case. The joins between panels do not need the conventional techniques of filling and taping but should be as clean as possible.

Thus, while wrapping of the panel edges of cladding panels embodying the invention may be useful protection in transport, such wrapping should be around sharp edges. It may even be desirable to cut the edges for fitting.

It may be convenient that the one half of the hook and loop fastening means provided on the cladding sheet material be the hooked half. There may be some attachment effect between two hooked surfaces and, hence, any such effect may help in holding panels together in pairs for transport. In this specification it will, hereafter, be assumed that it is the hooked half of the attachment system on the cladding panels, although it is to be noted that it is possible that the looped half may be used instead with the hooked half being on any complementary surface.

The hooked attachment half may be distributed over substantially one full surface of the board unit, i.e. its anterior face.

While the cladding system may be connected to the support in any suitable manner, the present invention in addition in another aspect provides a cladding system for detachable semi-permanent application to a support by a hook and loop fastening, the cladding having a reverse surface incorporating over at least a portion of the area a plurality of fastening elements selected from the hooks and loops for removably securing the component to the support. When the support is a wall, the cladding system may be directly attached to an open frame work of, for example, I-beams or 2 × 4 lumber struts to form the wall or a base wall surface may be interposed between frame and cladding. Moreover, the cladding may be attached to a solid wall When the support is a floor, it may suitably be a subfloor or a solid floor. The support may be, for example, a beam or truss having a face area incorporating a complementary one of the fastening means to receive the cladding panel. When, for example, a base wall is interposed between support and cladding panel, then the hook and loop fastening will be between the base wall and the cladding panel. A double faced I-joist may support cladding panel on each side so that the web of the I extends between parallel panels. Thus, for example, horizontal panels may form a floor of one room and a ceiling of another. Alternatively, vertical panels may form opposing faces or a wall. The hooked front face of the cladding may be used to attach finishing sheet such as wallpaper, plastic, paneling or textiles. Such finishing sheets may be made of cloth, vinyl, other plastic, wood or any other suitable sheet material. All these sheets should be provided with a looped attachment half on their rear surfaces. However, some textiles, although not manufactured with the intention of providing a looped attachment surface, do so provide as an inherent characteristic of the textiles. Such materials may be adhered directly to a hooked attachment surface without special provision of an additional looped surface. In this case it is important that the cladding have a hooked attachment surface.

Other finishing materials may be utilized for as baseboard, coving, door and window trim and wiring conduit each of which may be applied in an area not covered by finishing sheet by looped rear surfaces. Indeed, where cladding has been wholly covered by finishing sheet, sections of the finishing sheet may be cut away and removed to expose hooked surface for attachment of alternative finish materials.

When the cladding panels are flooring panels, then the finishing material may suitably be carpet which may be applied in a similar manner to that disclosed in my co-pending U.S. patent now issued as U.S. Pat. No. 4,822,658.

The cladding panels may be provided with an edge profiled to facilitate forming of external corners. Such profiling may be a border of diminished thickness adapted to accommodate suitable corner trim so that the surface of the corner trim is flush with the surface of other finish sheet. In this case, any cutting of the panels must be at an edge other than that adapted for the corner trim if the benefit is to be utilized. It is, of course, possible to cut the panels at the especially adapted edge if it is not desired to utilize corner trim.

Further, it is contemplated that specialty cladding panels may be provided, each panel having one edge border of thickened proportions. Such a thickened border may be located at floor level and used in combination with specialty baseboard concave to its rear.

Ancillary boards may also be provided to supplement the board thickness, for decorative and other purposes, such as utility services, for supporting wiring conduits or other services in concealed, externally accessible relation, for the location of electrical wiring, etc. for power, communication, computer and other services.

This aspect of the invention has the great advantage of permitting wiring to be carried out substantially completely subsequent to the finishing of a room, thereby eliminating preliminary rough wiring. This affords a particular advantage that internal arrangements such as location of desks and any associated electrical equipment such as computers, printers etc. can be almost totally flexible, in relation to adjacent wall surfaces.

The construction of the cladding panels for use in walls may be generally plasterboard having high fire retardant characteristics. The hook and loop fastening system may be formed from substantially flameproof, non-toxic plastic material. It is possible, however, for the cladding panels to be formed of any suitable substance, such as for example plaster or fibreglass or even plywood. It is preferable, however, that such substances be flame retardant or even fireproof and reasonably inexpensive. Plaster and fibreglass have the additional advantage that the hooks or loops can be manufactured into the cladding during construction of the board.

In one embodiment, when the cladding is plaster board, the hook means is secured and protrudes from a substantially continuous film or mesh. In manufacturing the cladding panels, the continuous film mesh or other anchor strata may be readily incorporated into the panels during manufacture. The incorporation into the film or mesh of protruding root members, or perforations for setting into the plaster, or the provision of a surface active adherent layer to effect adherence of the hook strata to the plaster material of the board body is contemplated, together with utilization of a paperboard outer sheet layer as the reverse board face. Normally the board will be manufactured with the hook or loop attachment system incorporated in or on the board so that the board can be transported to a site and cut and fit in place like conventional drywall.

Characteristic panel dimensions generally comprise rectangular panels in standard two foot and four foot widths, in standard one foot increments in length from six feet to ten feet. Other sizes may well be adopted in accordance with user needs.

Panel thickness comprise adopted standards, generally a nominal one-half inch thick or three-quarter inch thick, excluding the height of the hooked attachment half. Panel thickness may vary, on the adoption of different materials and in conformity with building codes and other requirements. Benefits in sound absorbency characteristics and some improvement in the currently negligible thermal insulation "R" values are anticipated.

Handling of the panels in pairs, having the anchor strata faces in adjoining face to face relation is contemplated, with probable weight restrictions on vertical stacking, to avoid hook damage.

Attachment of the panels to floors, walls and ceilings is contemplated generally by nailing, stapling, gluing and the like. However, the extension of the system, using respective hook and loop fastenings, for attachment of the panels to underlying supports is considered part of the system, which thus includes the underlying supports with their respective loop or hook attachments.

It will be appreciated that the incorporation of film or mesh into plasterboard type panels will lead to reinforcement of such panels. Such reinforcement facilitates the use of stapling machines to wire staple the boards to studding or other supports. The staples and other fasteners which might pull through conventional surfaces have less tendency to pull through due to the reinforcement. Thus, reductions in installation labour costs are possible because cost-effective fastening techniques may be used which are not possible with conventional plasterboard. Moreover, when nails or screws are used to attach conventional plasterboard to the support, the board tends to be dented especially when nails are used. The nail or screw heads are covered with plaster flush with the surface of the board. However, when nails or screws are used with cladding of the present invention, there will be a tendency for the resilient hook and loop fastening between the cladding and a finish sheet to absorb or disguise any dent at the nail or screw head.

BRIEF DESCRIPTION OF THE DRAWINGS

Embodiments of the present invention will now be described by way of example with reference being made to the accompanying drawings, wherein:

FIG. 7 is a vertical section of part of another cladding panel embodying the present invention;

FIG. 8 is a section of a corner assembly of parts of a panel as shown in FIG. 2 with corner trim;

FIG. 9 is a perspective view of a portion of an I-beam support joist to a panel; and FIG. 10 is a perspective view partly in section of a stud having a flange plate having attachment for a panel.

DETAILED DESCRIPTION OF PREFERRED EMBODIMENTS

Figure 1:
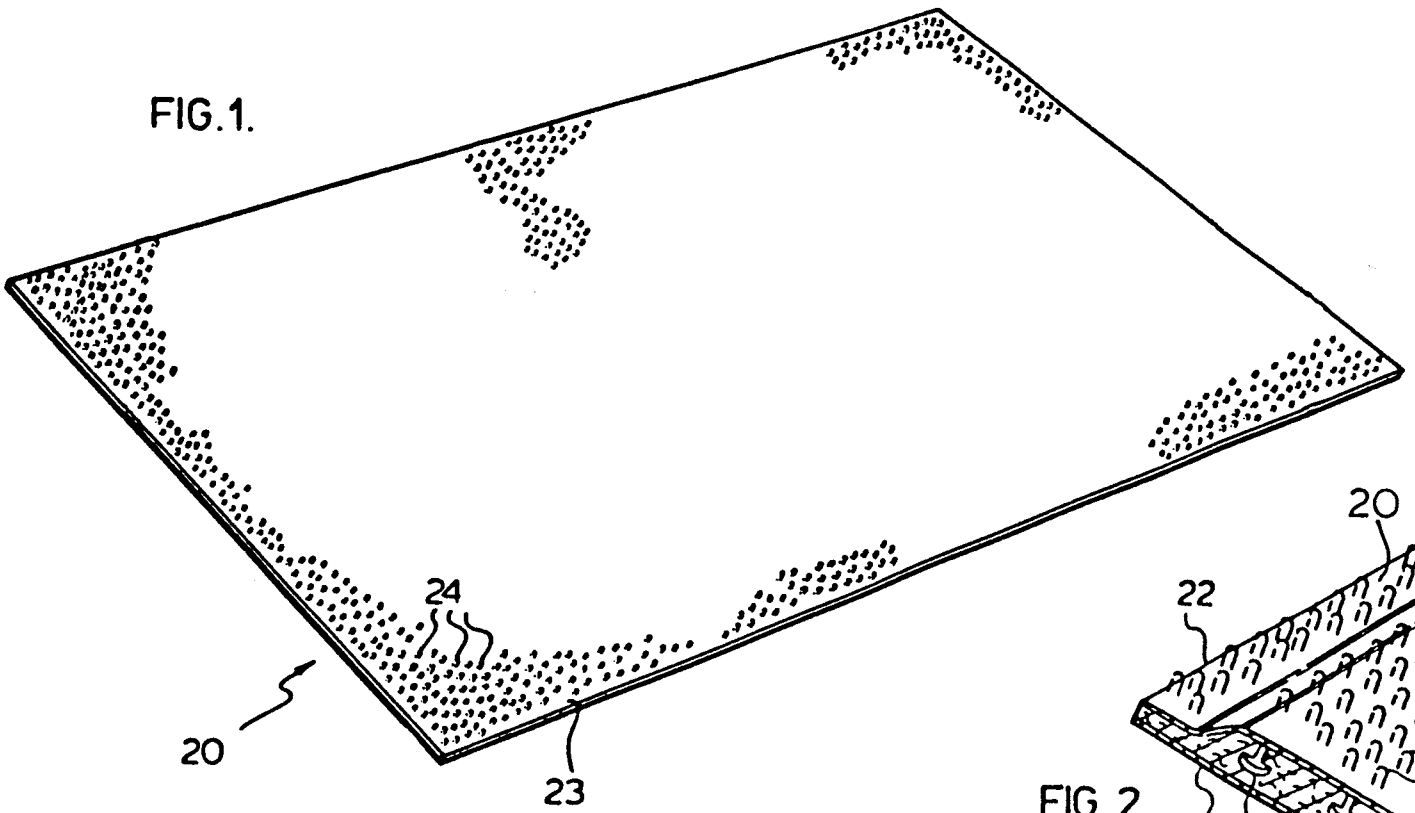
FIG. 1 is a general view of a panel of cladding embodying the present invention.
Figure 2:
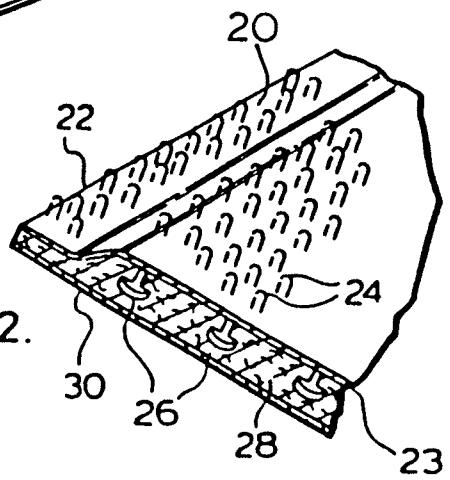
FIG. 2 is an enlarged general view of a corner of another cladding panel embodying the invention.

A cladding panel 20 as shown in FIG. 1 may have typical dimensions of a conventional plasterboard panel i.e. four feet width by eight feet length, a base thickness of one half inch (nominal). Additional thickness is provided through the hooks 24 of hook and loop fastening means. The hooks 24 may be provided on a film 23 secured to panel 20 and anchored with respect thereto by anchor lugs 26 (see FIG. 2). The body portion 28 of the panel comprises plaster, bounded by a rear paper layer 30. The film 23 may suitably be replaced by a mesh embedded in the body of the plasterboard such that the hooks 24 extend out of the surface.

Figures 3, 4:
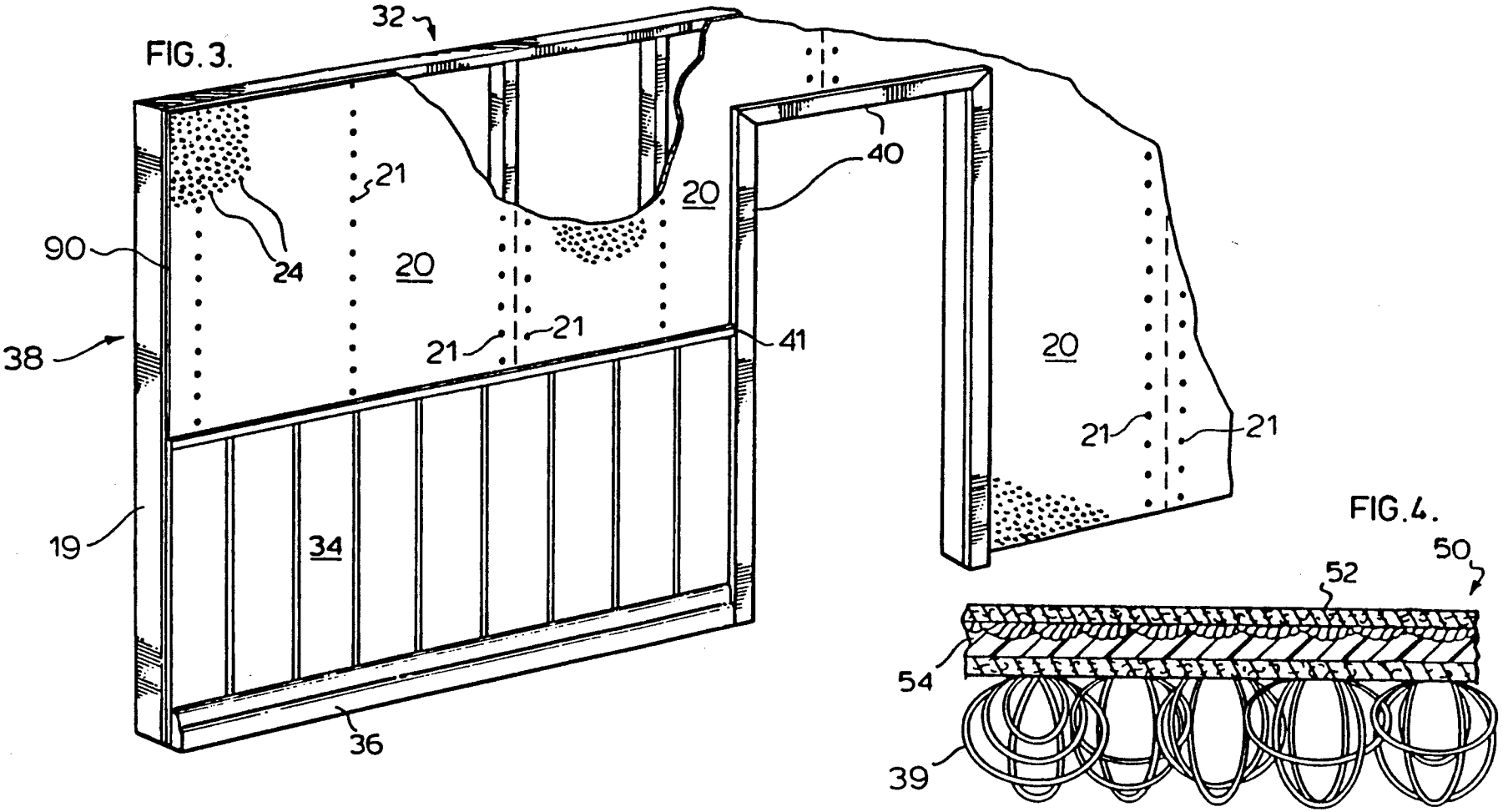
FIG. 3 is a general view of a portion of a partition wall incorporating panels of cladding embodying with the invention.
FIG. 4 is a section of a portion of a finish sheet for use with panels as shown in any of the previous Figures.

The panel 20 may be used in a manner somewhat similar to that of conventional plasterboard and panels may be fitted together and cut to size for example as shown in FIG. 3 which, for the purposes of illustrating an embodiment of the invention illustrates a pier wall 38.

FIG. 3 wall frame 32 of conventional two by four wood construction or of prefabricated sheet metal joists has cladding panels 20 nailed thereto with nails 21, divisions between the panels being shown in phantom. Wainscot paneling 34 may be attached to panels 20 by way of the hooks 24, which cover substantially the whole of the front surface of panels 20. Above the wainscot paneling 34, wallpaper, textile or plastic sheet 50 may be applied by hook and loop attachment. Such sheet 50 is not shown in FIG. 3 for simplicity but an enlarged section of a portion of such sheet is shown in FIG. 4.

Below the wainscot paneling 3 a baseboard 36 has hook portions 24 to engage loops on the backing for the baseboard 36. A doorway is bounded by trim molding 40, also attached to the cladding panels 20 by hooks 24 and loops backing the door trim 40. The door trim 40 may have a recess in its rear edge to accommodate an overlay 41 for the wainscot paneling 34.

While the loops on the back of the wainscot paneling 34, the baseboard 36 and the door trim 40 have not been particularly illustrated, they may be secured thereto in the same manner as illustrated in FIG. 4 which illustrates the securement of attachment loops to any finish sheeting such as wallpaper.

A portion of a finish sheet 50 has a finished decorative front surface 52, an intermediate laminate or glue portion 54 and an adhering layer 38 of woven or felted loops, for attachment to the hooks 24 of the cladding 20 behind it.

It may be seen that the finish sheet may be wallpaper, plastic, paneling, textile, ceiling tiles, carpet, carpet tiles etc.

FIG. 4 may be taken to also illustrate door trim, window trim, coving, baseboard, wiring conduit, switch covers, pictures and the like.

Figure 5:
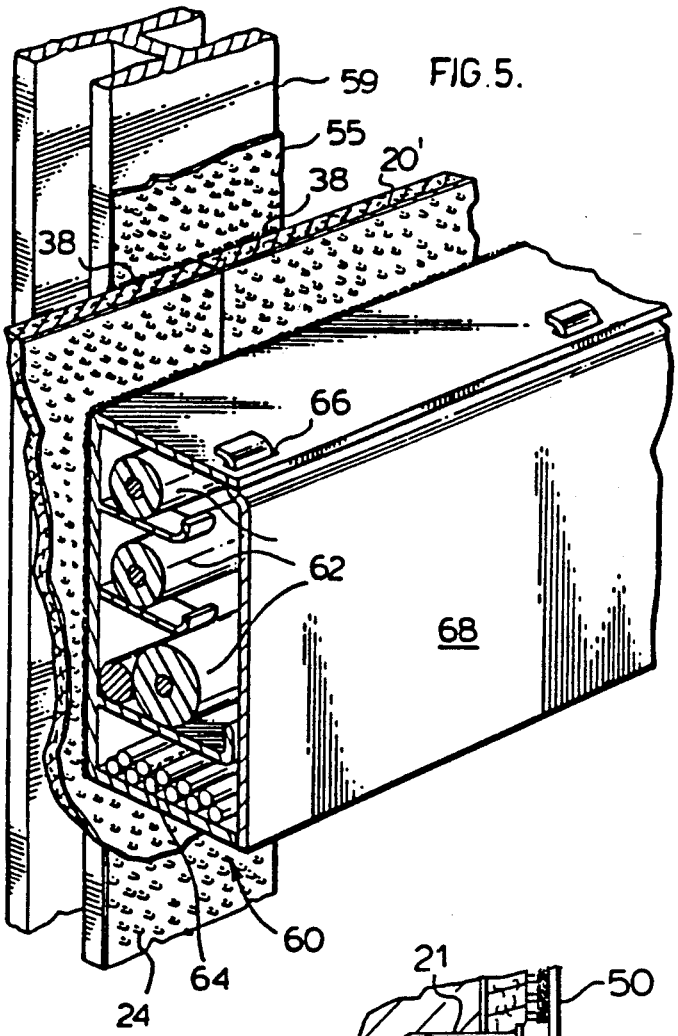
FIG. 5 is a perspective view partly in section of a finish unit comprising wiring conduit in attached relation with panels of cladding embodying the invention.

FIG. 5 shows a portion of a wiring conduit 60, illustrated as being of shallow depth, with accommodation for three or more electrical conductors 62 and a separate compartment 64 to receive telephone and other telecommunications lines and computer lines therein. Hinge apertures 66 receive attachment lugs of a flame proof cover plate 68.

At the free end of pier wall 38, two cladding panels 20, 19 meet at right angles. For such a join it is advantageous that the panels are provided with a modified border 25 along one edge 22 (see FIG. 2). Two such edges 22 may be located so that the panels are at right angles as shown enlarged in FIG. 8. A customized corner trim unit 90 may be used to provide flat wall surfaces to the corner point. The trim unit 9 has any desired external finish 92, a looped rear surface 39 on each of arms 93 and a flexible web 94 between arms 93. The flexible web 94 permits adjustment of trim unit 90 about a corner and the provision of borders 25 of reduced thickness allow finish 92 to be abutted precisely flush with finish sheet 50 on panels 20, 19.

FIG. 5 also shows, in addition to a hooked front face, with hook portions 24, a rear face of panel 20 having loops 39 on at least portions of panel 20 for attachment to hooked surface 55 of structural member 59.

Figure 6:
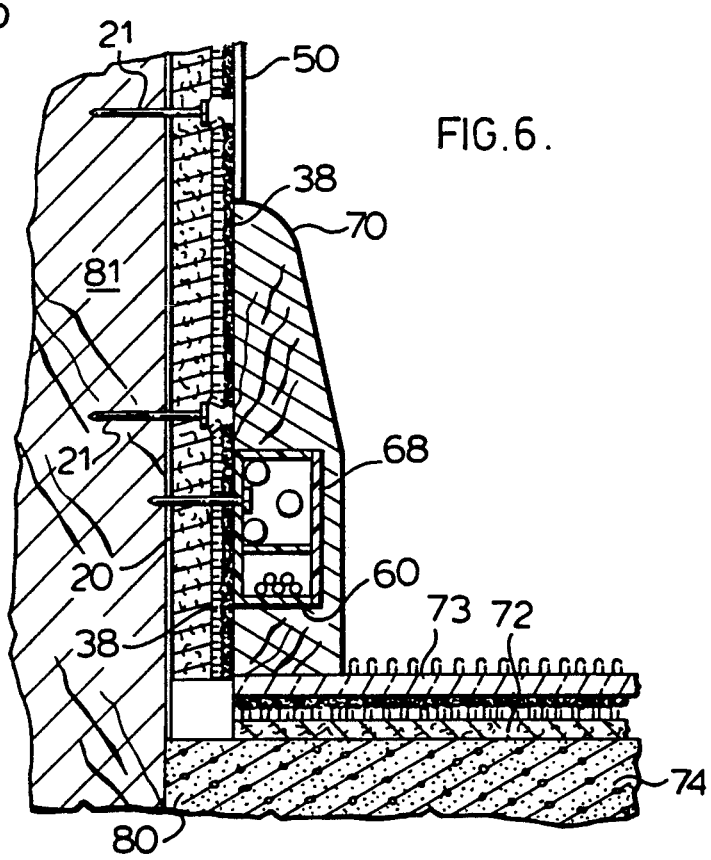
FIG. 6 is a vertical section of part of a wall and associated floor formed with panels of cladding embodying the present invention.

FIG. 6 shows wall cladding 20, embodying the invention and baseboard 70 housing a wiring conduit, the baseboard 70 adjoining floor cladding 72 also embodying the invention. Wall panels 20 formed basically of plasterboard are having a front surface provided with hooks 24, are nailed to wall supports such as stud 81 by nails 21. A finish sheet 50 is attached by hook and loop attachment over the surface of the wall formed by panels 20. A baseboard 70 is attached to panels 20 in a similar manner. Baseboard 70 is shown as housing wiring conduit 68. A concrete support base 74 is provided with a wooden subfloor 72 having one half of a hook and loop fastening system on its upper face. Above the subfloor is a floor cladding panel 73 embodying the invention attached to the subfloor through the hook and loop fastening system. The upper or front face of the cladding panel 73 is provided with hooks over its surface to cooperate with loops on a finish unit such as carpet sheet or carpet tiles. The floor cladding panel 73 may suitably be plywood or may be parquet flooring tiles.

FIG. 7 shows an embodiment where panel 20 has a lower thickened edge 27. Finish sheet 50 is attached to the panel 20 above the thickened edge by hooks 24 and loops 39 as previously described. Baseboard 66 is concave to its rear and is attached to thickened edge 27 by hooks 24 and loops 39. Due to the concave rear of baseboard 66, it may be of lighter weight than comparative baseboard to attach to a flat surface.

FIG. 9 shows the structural member 59 as an I-section joist having hooks 24 on the externally accessible surfaces, and service access ways provided through the web of the joist 59. In FIG. 10 is shown an attachable flange 96 secured by nails 97 and side pads 98 to a two by four joist, for attachment of panel 20 to the thus enlarged hooked flange surface.

It will be appreciated that the cladding may be mass produced with associated cost savings. The cladding and various attachments may provide a system adapted for extremely rapid erection, tear down and/or replacement. Furthermore, the various attachments parts may be substantially undamaged by installation and removal from the subject anchor sheets.

I claim:

1. Cladding to form interior surfaces of buildings, the cladding comprising plasterboard panels locatable edge to edge to form the interior surface of an area to be clad and adapted to be cut to fit the shape of said area and being attachable to a wall framework;

each panel having one-half of a hook and loop attachment system embedded in the plasterboard and projecting from a front surface and distributed at least substantially over the whole of the front surface, whereby finishing material having the other half of the hook and loop attachment system or a rear surface may be attached anywhere on the front surface.

2. Cladding as claimed in claim 1, in which the one half of the hook and loop attachment is connected to a base strata embedded in the plaster board.

3. Cladding as claimed in claim 2, in which the base strata is plastic mesh.

4. Cladding as claimed in claim 3, in which the one half of the hook and loop attachment system is the hooked half.

5. Cladding on an interior of a building, the cladding comprising:

adjacent plasterboard panels cut to each shape as required and attached to a wall framework, the panel having one-half of a hook and loop attachment system embedded in the plasterboard and projecting from a front surface and distributed at least substantially over the whole of the front surface;

a cover sheet selected for the group consisting of wall paper, textiles, plastic and paneling, having the other half of the hook and loop attachment system projecting from a rear surface being attached to the panels through the hook and loop attachment system, the cover sheet being substantially the height of an interior wall and adapted to be applied to cover vertical forms in the wall.

* * * * *